US008784138B2

(12) United States Patent
Shih et al.

(10) Patent No.: US 8,784,138 B2
(45) Date of Patent: Jul. 22, 2014

(54) CONNECTOR ASSEMBLY

(71) Applicant: Hon Hai Precision Industry Co., Ltd, New Taipei (TW)

(72) Inventors: Chi-Tse Shih, New Taipei (TW); Chin-Feng Chen, New Taipei (TW); Tay-Yang Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/726,406

(22) Filed: Dec. 24, 2012

(65) Prior Publication Data

US 2013/0280963 A1 Oct. 24, 2013

(30) Foreign Application Priority Data

Apr. 23, 2012 (TW) ..... 101114314 A

(51) Int. Cl.
*H01R 33/22* (2006.01)

(52) U.S. Cl.
USPC ..... 439/668

(58) Field of Classification Search
USPC ..... 439/76.1, 83, 84, 66, 668, 669, 222
See application file for complete search history.

(56) References Cited

U.S. PATENT DOCUMENTS

| | | | | |
|---|---|---|---|---|
| 5,415,570 | A * | 5/1995 | Sarkissian | 439/676 |
| 7,270,554 | B2 * | 9/2007 | Corey et al. | 439/222 |
| 7,749,028 | B2 * | 7/2010 | Feridani et al. | 439/660 |
| 7,824,230 | B1 * | 11/2010 | Ho | 439/669 |
| 8,041,047 | B2 * | 10/2011 | Matsumoto et al. | 381/71.1 |
| 2004/0147171 | A1 * | 7/2004 | Lai | 439/701 |
| 2009/0311915 | A1 * | 12/2009 | Stiehl | 439/669 |
| 2011/0144778 | A1 * | 6/2011 | Fung et al. | 700/90 |

* cited by examiner

*Primary Examiner* — Neil Abrams
*Assistant Examiner* — Phuongchi T Nguyen
(74) *Attorney, Agent, or Firm* — Novak Druce Connolly Bove + Quigg LLP

(57) ABSTRACT

A connector assembly includes a connector plug and a connector socket. The connector plug includes an outer surface having a first portion and a second portion. The first portion includes a plurality of first plug signal transmitting lines. The second portion includes a plurality of second plug signal transmitting lines. The first and second plug signal transmitting lines form a plurality of first homocentric circles. The connector socket includes an inner surface which includes a first area and a second area. The first area includes a plurality of first socket signal transmitting lines. The second area includes a plurality of second socket signal transmitting lines. The first and second socket signal transmitting lines form a plurality of second homocentric circles. The connector plug inserts in the connector socket to connect the first and second plug signal transmitting lines to the first and second socket signal transmitting lines respectively.

13 Claims, 2 Drawing Sheets

CONNECTOR ASSEMBLY

CROSS-REFERENCE TO RELATED APPLICATIONS

This application is related to another application, entitled "CONNECTOR ASSEMBLY" (attorney docket number US44542), filed simultaneously with this application, and having the same assignee as this application. The entire contents of the copending application are incorporated herein by reference.

BACKGROUND

1. Technical Field

The present disclosure relates to connector assemblies that can transmit a plurality of signals.

2. Description of Related Art

Connectors are widely used in electronic devices to transmit signals. For transmitting different signals, the electronic device often uses different connectors, and each connector transmits one kind of signal. Therefore, a plurality of different types of connector must be mounted on the electronic device, which has a high cost and consumes a lot of space in the electronic device.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
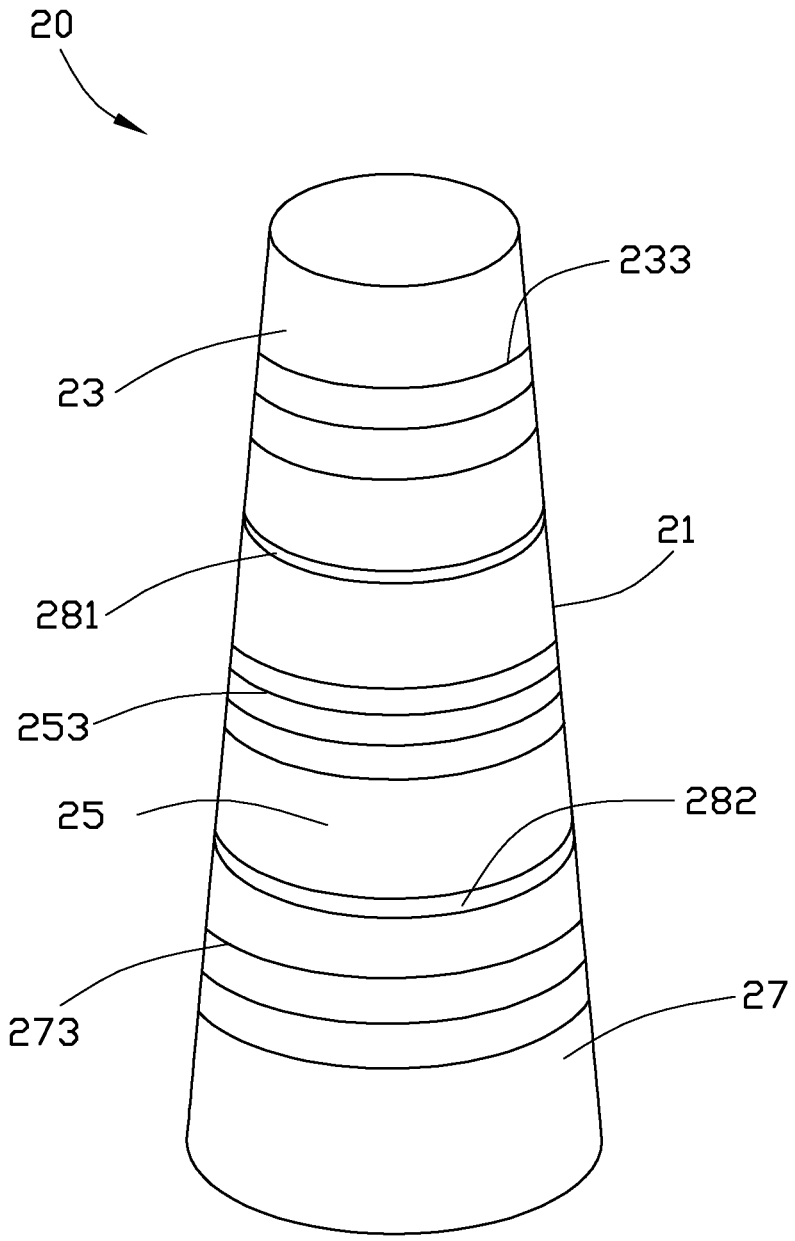
FIG. 1 is a sketch view of a connector plug of a connector assembly in accordance with an embodiment.
Figure 2:
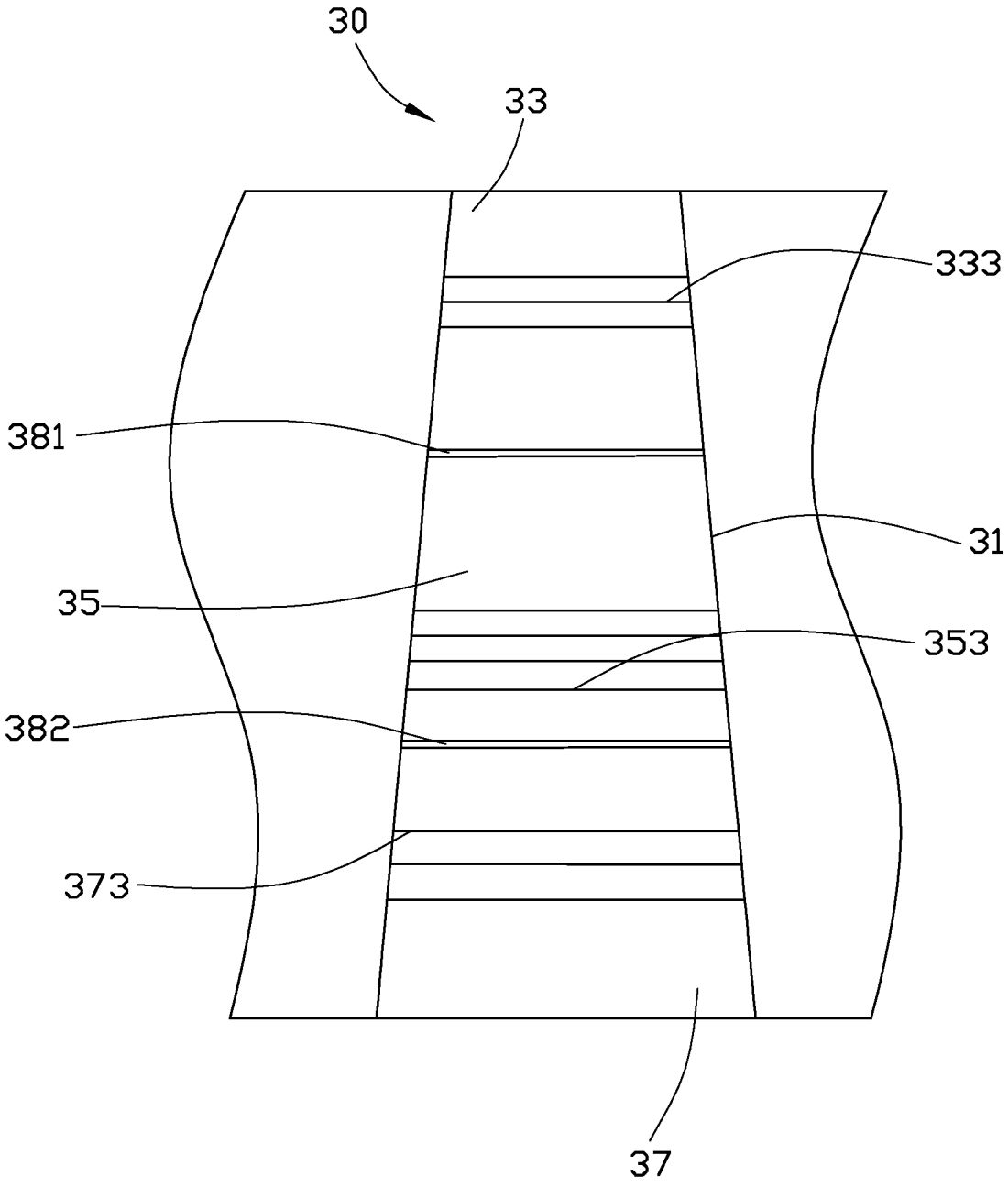
FIG. 2 is a sectional view of a connector socket of the connector assembly of FIG. 1.

Referring to FIGS. 1 and 2, a connector assembly in accordance with an embodiment includes a connector plug 20 and a connector socket 30.

Referring to FIG. 1, the connector plug 20 is the shape of a truncated cone which includes an outer surface 21. The outer surface 21 is divided into a plurality of portions in an axial direction. In one embodiment, the plurality of portions includes a first portion 23, a second portion 25, and a third portion 27. The first portion 23 is located on a topmost portion of the connector plug 20, and the third portion 27 is located on a bottommost portion of the connector plug 20. The second portion 25 is located between the first portion 23 and the third portion 27. A first insulating strip 281 is located between the first portion 23 and the second portion 25 to separate the first portion 23 from the second portion 25. A second insulating strip 282 is located between the second portion 25 and the third portion 27 to separate the second portion 25 from the third portion 27.

A plurality of first plug signal transmitting lines 233 are laid on the first portion 23. Each of the first plug signal transmitting lines 233 surrounds the plug 20. The plurality of first plug signal transmitting lines 233 transmit a first signal, such as a USB signal.

A plurality of second plug signal transmitting lines 253 are laid on the second portion 25. Each of the second plug signal transmitting lines 253 surrounds the plug 20. The plurality of second plug signal transmitting lines 253 transmit a second signal, such as an AGP signal.

A plurality of third plug signal transmitting lines 273 are laid on the third portion 27. Each of the third plug signal transmitting lines 273 surrounds the plug 20. The plurality of third plug signal transmitting lines 273 transmit a third signal, such as an audio signal.

The plurality of first plug signal transmitting lines 233, the second plug signal transmitting lines 253, and the third plug signal transmitting lines 273 form a plurality of first homocentric circles on the outer surface 21 on the outer surface 21. The plurality of first homocentric circles have different diameters.

Referring to FIG. 2, the connector socket 30 receives the connector plug 20. The connector socket 30 is substantially hollow, of a shape which matches that of the connector plug 20, and includes an inner surface 31. The inner surface 31 is divided into a plurality of portions. In one embodiment, the plurality of portions includes a first area 33, a second area 35, and a third area 37. The first area 33 is located on a topmost portion of the connector socket 30 (that is to say, the portion of a truncated cone with the smallest diameter), and the third area 37 is located on a bottommost portion of the connector socket 30 (that is to say, the portion of a truncated cone with the largest diameter). The second area 35 is located between the first area 33 and the third area 37. A first insulating portion 381 is located between the first area 33 and the second area 35 to separate the first area 33 from the second area 35. A second insulating portion 382 is located between the second area 35 and the third area 37 to separate the second area 35 from the third area 37.

A plurality of first socket signal transmitting lines 333 are laid on the first area 33. Each of the first socket signal transmitting lines 333 is a circle. The plurality of first socket signal transmitting lines 333 transmit the first signal.

A plurality of second socket signal transmitting lines 353 are laid on the second area 35. Each of the second socket signal transmitting lines 353 is a circle. The plurality of second socket signal transmitting lines 353 transmit the second signal.

A plurality of third socket signal transmitting lines 373 are laid on the third area 37. Each of the third socket signal transmitting lines 373 is a circle. The plurality of third socket signal transmitting lines 373 transmit the third signal.

The plurality of first socket signal transmitting lines 333, the plurality of second socket signal transmitting lines 353, and the plurality of third socket signal transmitting lines 373 form a plurality of second homocentric circles on the inner surface 31. The plurality of second homocentric circles have different diameters.

To join the connector plug 20 and the connector socket 30, the connector plug 20 is inserted in the connector socket 30. The first plug signal transmitting lines 233 are coupled to the first socket signal transmitting lines 333. The second plug signal transmitting lines 253 are coupled to the second socket signal transmitting lines 353. The third plug signal transmitting lines 273 are coupled to the third socket signal transmitting lines 373. The first insulating strip 281 contacts the first insulating portion 381. The second insulating strip 282 contacts the second insulating portion 382. The connector plug 20 and the connector socket 30 thus exchange three different kinds of signal simultaneously, with each type of signal independent of the others.

In another embodiment, the connector plug 20 and the connector socket 30 can provide connections to enable the exchange of two, four, five or more different kinds of signals.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A connector assembly, comprising:

a connector plug comprising an outer surface, the outer surface comprising a first portion and a second portion, a plurality of first plug signal transmitting lines laid on the first portion, a plurality of second plug signal transmitting lines laid on the second portion, and the plurality of first plug signal transmitting lines and the plurality of second plug signal transmitting lines form a plurality of first homocentric circles; and a connector socket comprising an inner surface, the inner surface is divided into a first area and a second area, a plurality of first socket signal transmitting lines laid on the first area, a plurality of second socket signal transmitting lines laid on the second area, and the plurality of first socket signal transmitting lines and the plurality of second socket signal transmitting lines form a plurality of second homocentric circles;

wherein the connector plug is configured to insert in the connector socket to connect the plurality of first plug signal transmitting lines to the plurality of first socket signal transmitting lines to transmit a first signal, and simultaneously connect the plurality of second plug signal transmitting lines to the plurality of second socket signal transmitting lines to transmit a second signal.

2. The connector assembly of claim 1, wherein the connector plug is the shape of a truncated cone, the first portion is located above the second portion, and the first area is located above the second area.

3. The connector assembly of claim 1, wherein the first portion and the second portion are separated by a first insulating strip, the first area and the second area are separated by a first insulating portion, and the first insulating strip is configured to contact the first insulating portion when the connector plug is inserted in the connector socket.

4. The connector assembly of claim 1, wherein each of the plurality of first plug signal transmitting lines and the plurality of second plug signal transmitting lines surrounds the connector plug.

5. The connector assembly of claim 1, wherein the plurality of first homocentric circles have different diameters.

6. The connector assembly of claim 5, wherein the plurality of second homocentric circles have different diameters.

7. A connector assembly, comprising:

a connector plug comprising an outer surface, a first insulating strip divides the outer surface into a first portion and a second portion, a plurality of first plug signal transmitting lines laid on the first portion, a plurality of second plug signal transmitting lines laid on the second portion, and each of the plurality of first plug signal transmitting lines and the plurality of second plug signal transmitting lines surrounds the connector plug; and a connector socket comprising an inner surface, a first insulating portion divides the inner surface into a first area and a second area, a plurality of first socket signal transmitting lines laid on the first area, a plurality of second socket signal transmitting lines laid on the second area, and each of the plurality of first socket signal transmitting lines and the plurality of second socket signal transmitting lines is a circle;

wherein the connector plug is configured to insert in the connector socket to connect the plurality of first plug signal transmitting lines to the plurality of first socket signal transmitting lines to transmit a first signal, and simultaneously connect the plurality of second plug signal transmitting lines to the plurality of second socket signal transmitting lines to transmit a second signal.

8. The connector assembly of claim 7, wherein the connector plug is a truncated cone, the first portion is located above the second portion, and the first area is located above the second area.

9. The connector assembly of claim 7, wherein the first insulating strip is configured to contact the first insulating portion when the connector plug is inserted in the connector socket.

10. The connector assembly of claim 7, wherein the plurality of first plug signal transmitting lines and the plurality of second plug signal transmitting lines form a plurality of first homocentric circles.

11. The connector assembly of claim 10, wherein the plurality of first homocentric circles have different diameters.

12. The connector assembly of claim 7, wherein the plurality of first socket signal transmitting lines and the plurality of second socket signal transmitting lines form a plurality of second homocentric circles.

13. The connector assembly of claim 12, wherein the plurality of second homocentric circles have different diameters.

* * * * *